US006233891B1

(12) United States Patent
De Cosse

(10) Patent No.: US 6,233,891 B1
(45) Date of Patent: May 22, 2001

(54) PREFABRICATED BUILDING SYSTEM

(76) Inventor: Keith A. De Cosse, Box 505, Fruitvale, BC (CA), V0G 1L0

( * ) Notice: Subject to any disclaimer, the term of this patent is extended or adjusted under 35 U.S.C. 154(b) by 0 days.

(21) Appl. No.: 09/267,016

(22) Filed: Mar. 11, 1999

(51) Int. Cl.[7] ..... E04B 2/18

(52) U.S. Cl. ..... 52/309.12; 52/250; 52/262; 52/285.2; 52/585.1; 52/587.1; 411/182; 411/180

(58) Field of Search ..... 52/309.12, 250, 52/251, 262, 264, 267, 268, 270, 272, 285.2, 585.1, 587.1, 583.1; 411/182, 176, 172, 180

(56) References Cited

U.S. PATENT DOCUMENTS 3,137,967 * 6/1964 Flieth ..... 52/264
3,199,827 * 8/1965 Terry ..... 52/251
3,383,817 * 5/1968 Gregori ..... 52/309.12 X
4,067,165 * 1/1978 Timmons ..... 52/585.1
4,067,758 * 1/1978 Sommer ..... 52/309.12 X
4,104,842 * 8/1978 Rockstead et al. ..... 52/309.12 X
4,249,354 * 2/1981 Wynn ..... 52/309.12 X
4,281,495 * 8/1981 Lee ..... 52/285.2 X
4,295,415 * 10/1981 Schneider, Jr. ..... 52/309.12 X
4,694,624 * 9/1987 Juhas ..... 52/270 X
5,845,441 * 12/1998 Swartz ..... 52/250
6,058,672 * 5/2000 McClellan ..... 52/309.12 X

FOREIGN PATENT DOCUMENTS

1918965 * 11/1970 (DE) ..... 52/285.2

* cited by examiner

*Primary Examiner*—Carl D. Friedman
*Assistant Examiner*—Phi Dieu Tran A

(57) ABSTRACT

A prefabricated building system for constructing a building structure. The prefabricated building system includes a plurality of panels each comprising an outer shell substantially surrounding an inner core. The outer shell comprises a concrete material. The inner core comprises a mixture of a concrete material and particulate foamed polystyrene. A pair of reinforcing meshes are embedded in the outer core so that the inner core is interposed between the reinforcing meshes. Each reinforcing mesh has a plurality of wires arranged in a grid-like fashion forming a plurality of generally square spaces therebetween.

14 Claims, 3 Drawing Sheets

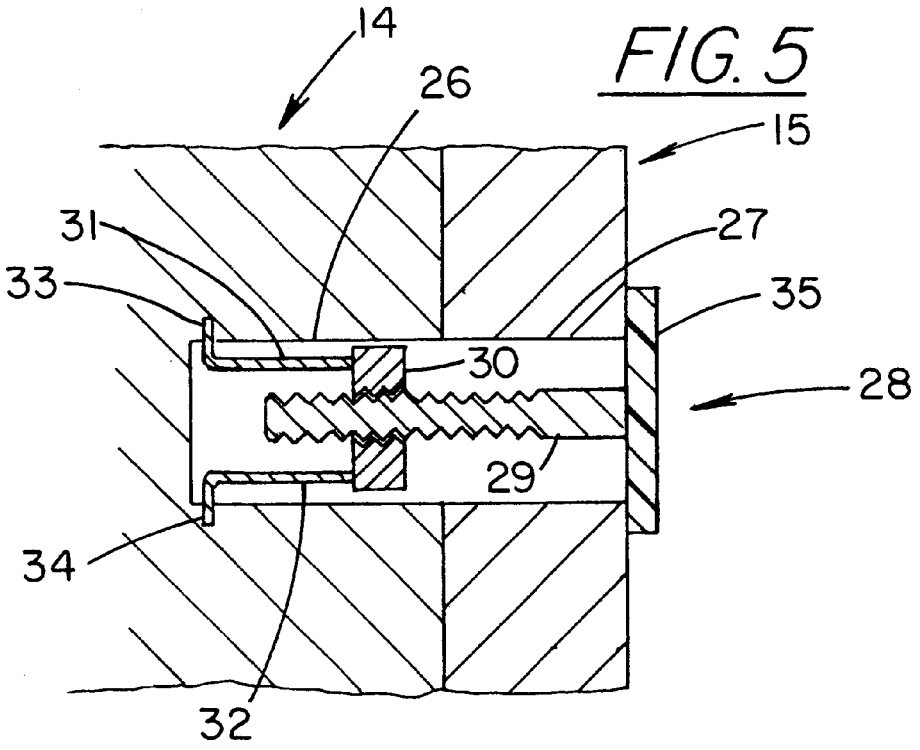
FIG. 5
FIG. 6
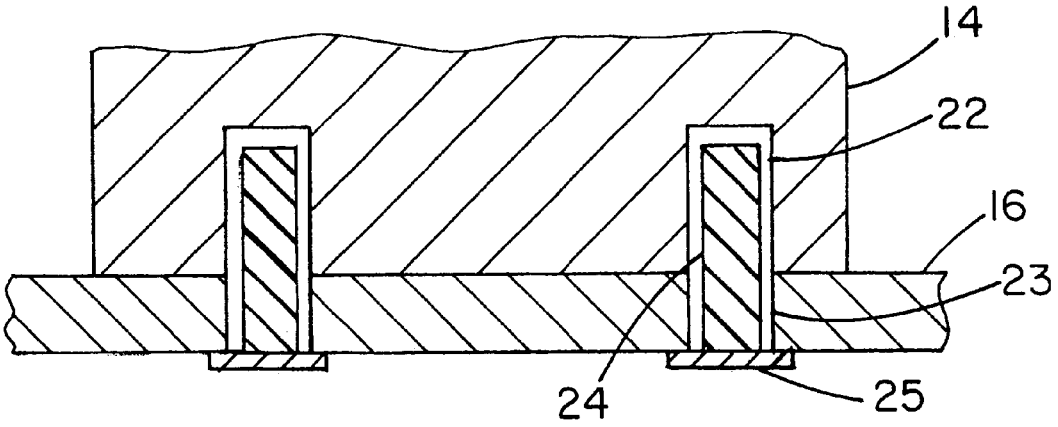

PREFABRICATED BUILDING SYSTEM

BACKGROUND OF THE INVENTION

1. Field of the Invention

The present invention relates to prefabricated building systems and more particularly pertains to a new prefabricated building system for constructing a building structure.

2. Description of the Prior Art

The use of prefabricated building systems is known in the prior art. More specifically, prefabricated building systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,410,044; 5,373,674; 5,172,532; U.S. Pat. No. Des. 354,358; U.S. Pat. Nos. 3,204,381; and 3,223,576.

While these devices fulfill their respective, particular objectives and requirements, the aforementioned patents do not disclose a new prefabricated building system. The inventive device includes a plurality of panels each comprising an outer shell substantially surrounding an inner core. The outer shell comprises a concrete material. The inner core comprises a mixture of a concrete material and particulate foamed polystyrene. A pair of reinforcing meshes are embedded in the outer core so that the inner core is interposed between the reinforcing meshes. Each reinforcing mesh has a plurality of wires arranged in a grid-like fashion forming a plurality of generally square spaces therebetween.

In these respects, the prefabricated building system according to the present invention substantially departs from the conventional concepts and designs of the prior art, and in so doing provides an apparatus primarily developed for the purpose of constructing a building structure.

SUMMARY OF THE INVENTION

In view of the foregoing disadvantages inherent in the known types of prefabricated building systems now present in the prior art, the present invention provides a new prefabricated building system construction wherein the same can be utilized for constructing a building structure.

The general purpose of the present invention, which will be described subsequently in greater detail, is to provide a new prefabricated building system apparatus and method which has many of the advantages of the prefabricated building systems mentioned heretofore and many novel features that result in a new prefabricated building system which is not anticipated, rendered obvious, suggested, or even implied by any of the prior art prefabricated building systems, either alone or in any combination thereof.

To attain this, the present invention generally comprises a plurality of panels each comprising an outer shell substantially surrounding an inner core. The outer shell comprises a concrete material. The inner core comprises a mixture of a concrete material and particulate foamed polystyrene. A pair of reinforcing meshes are embedded in the outer core so that the inner core is interposed between the reinforcing meshes. Each reinforcing mesh has a plurality of wires arranged in a grid-like fashion forming a plurality of generally square spaces therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new prefabricated building system apparatus and method which has many of the advantages of the prefabricated building systems mentioned heretofore and many novel features that result in a new prefabricated building system which is not anticipated, rendered obvious, suggested, or even implied by any of the prior art prefabricated building systems, either alone or in any combination thereof.

It is another object of the present invention to provide a new prefabricated building system which may be easily and efficiently manufactured and marketed.

It is a further object of the present invention to provide a new prefabricated building system which is of a durable and reliable construction.

An even further object of the present invention is to provide a new prefabricated building system which is susceptible of a low cost of manufacture with regard to both materials and labor, and which accordingly is then susceptible of low prices of sale to the consuming public, thereby making such prefabricated building system economically available to the buying public.

Still yet another object of the present invention is to provide a new prefabricated building system which provides in the apparatuses and methods of the prior art some of the advantages thereof, while simultaneously overcoming some of the disadvantages normally associated therewith.

Still another object of the present invention is to provide a new prefabricated building system for constructing a building structure.

Yet another object of the present invention is to provide a new prefabricated building system which includes a plurality of panels each comprising an outer shell substantially surrounding an inner core. The outer shell comprises a concrete material. The inner core comprises a mixture of a concrete material and particulate foamed polystyrene. A pair of reinforcing meshes are embedded in the outer core so that the inner core is interposed between the reinforcing meshes. Each reinforcing mesh has a plurality of wires arranged in a grid-like fashion forming a plurality of generally square spaces therebetween.

Still yet another object of the present invention is to provide a new prefabricated building system that is fire retardant, easy to erect, water resistant and insulated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic cross sectional view of the coupling of a pair of adjacent wall panels with a corner anchor forming a corner in a building structure.

FIG. 6 is a schematic cross sectional view of a mounting of a wall panel to a floor panel.

DESCRIPTION OF THE PREFERRED EMBODIMENT

Figure 1:
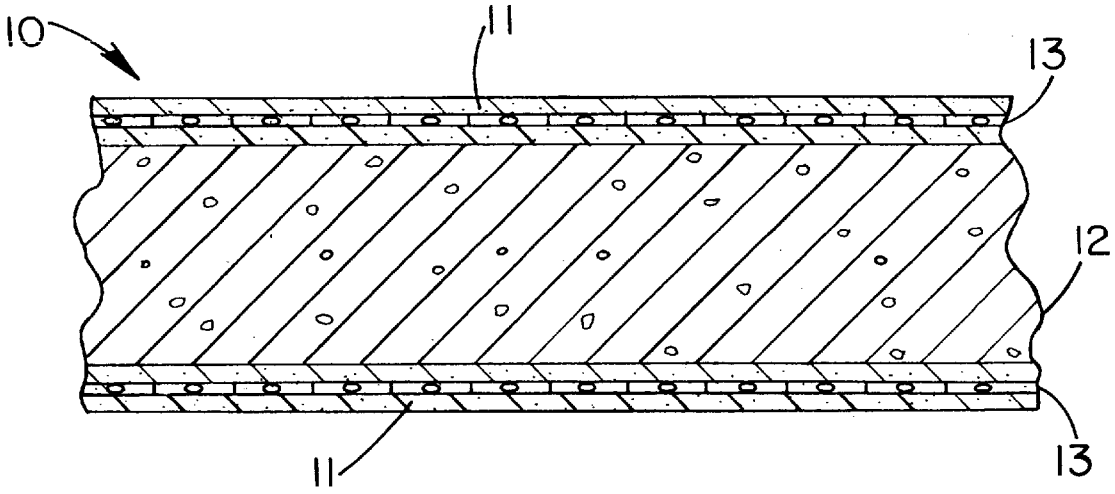
FIG. 1 is a schematic cross sectional view of a new prefabricated building system according to the present invention.

With reference now to the drawings, and in particular to FIGS. 1 through 6 thereof, a new prefabricated building system embodying the principles and concepts of the present invention will be described.

As best illustrated in FIGS. 1 through 6, the prefabricated building system generally comprises a plurality of panels each comprising an outer shell substantially surrounding an inner core. The outer shell comprises a concrete material. The inner core comprises a mixture of a concrete material and particulate foamed polystyrene. A pair of reinforcing meshes are embedded in the outer core so that the inner core is interposed between the reinforcing meshes. Each reinforcing mesh has a plurality of wires arranged in a grid-like fashion forming a plurality of generally square spaces therebetween.

In closer detail, the building system comprises a plurality of panels 10 each comprising an outer shell 11 substantially surrounding an inner core 12. The outer shell defines a space therein which the inner core preferably substantially occupies. The outer shell comprises a concrete material, preferably, the concrete material of the outer shell comprises at least about 98 percent by volume of the outer shell. The inner core comprises a mixture of a concrete material and particulate foamed polystyrene. Preferably, the concrete material of the inner shell comprises about 94 percent by volume of the inner shell and the particulate foamed polystyrene of the inner shell comprises about 6 percent by volume of the inner shell. The outer shell and the inner core each have a thickness. The thickness of the inner core is greater than the thickness of the outer shell. Ideally, the thickness of the outer shell is about 1 inch.

A pair of reinforcing meshes 13 are embedded in the outer core so that the inner core is interposed between the reinforcing meshes. Each reinforcing mesh has a plurality of wires arranged in a grid-like fashion forming a plurality of generally square spaces therebetween. Each of the spaces of the reinforcing meshes has a length and a width preferably about equal to one another. Ideally, the length of each space of the reinforcing meshes is about 2 inches and the width of each space of the reinforcing meshes is about 2 inches.

Each of the panels is generally rectangular and has a generally rectangular outer perimeter, and first and second faces. The plurality of panels includes at least one wall panel 14,15 and at least one floor panel 16. The outer perimeter of each wall panel has top and bottom edges 17,18 and a pair of side edges 19,20 extending between the top and bottom edges of the respective wall panel. The top and bottom edge of each wall panel is preferably extended substantially parallel to one another and substantially perpendicular to the side edges of the respective wall panel.

The top and bottom edges of each wall panel has a row of generally cylindrical bores 21,22 therein extending between side edges of the respective wall panel. The bores of each edge are spaced apart in the respective row at generally equal intervals. Ideally, the bores of the top and bottom edges of the wall panels each have a diameter of about 1¼ inches and a depth defined from the associate edge of the respective wall panel of about 10 inches.

In use, the floor panel is designed for positioning in a generally horizontal position and preferably rested on a foundation structure such that the first and second faces of the floor panel lie in generally horizontal planes. The floor panel has a plurality of spaced apart generally cylindrical bores 23 therethrough between the first and second faces of the floor panel. The bores of the floor panel are arranged around the outer perimeter of the floor panel. Preferably, the bores of the floor panel are spaced apart at about equal intervals. Ideally, the interval between bores of the floor panel is about equal to the interval between bores of the bottom edge of the wall panel.

In use, the bottom edges of the wall panels are rested on the first face of the floor panel such that the wall panels are extended substantially perpendicular to the floor panel. A first of the wall panels 14 is positioned along a first side of the floor panel and a second of the walls panels 15 is positioned along a second side of the floor panel adjacent the first side of the floor panel. Each of the bores of the bottom edge of the first wall panel is associated with a corresponding bore of the floor panel adjacent the first side of the floor panel and each of the bores of the bottom edge of the second wall panel is associated with a corresponding bore of the floor panel adjacent the second side of the floor panel. The wall panels are position on the floor panel so that bores of the bottom edges of the first and second wall panels are generally coaxially aligned with the associated corresponding bore of the floor panel.

A plurality of rebar 24 is provided with a rebar upwardly extended through each bore of the floor panel into the associated bore of the bottom of the respective wall panel to hold the respective wall panel substantially perpendicular to the floor panel. As illustrated in FIG. 6, preferably, each rebar has a generally rectangular base 25 coupled to an end of the respective rebar adjacent the second face of the floor panel so that the bases of the rebar abut the second face of the floor panel.

In use, a first side edge of the first wall panel abuts the first face of the second wall panel adjacent a first side edge of the second wall panel. The first side edge of the first wall panel has a row of linking bores 26 therein extending between the top and bottom edges of the first wall panel. Preferably, the linking bores of the first side edge of the first wall panel are spaced apart in the row at generally equal intervals. The second wall panel also has a row of linking bores 27 extending therethrough between the first and second faces of the second wall panel adjacent the first of the side edges of the second wall panel. Each of the linking bores of the first side edge of the first wall panel is associated with a corresponding linking bore of the second wall panel. In use, the linking bores of the first side edge of the first wall panel are generally coaxially aligned with the associated corresponding linking bore of the second bore.

Figure 4:
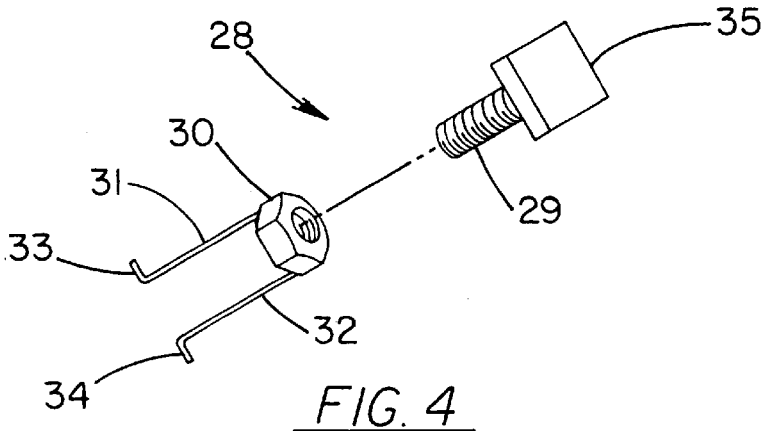
FIG. 4 is a schematic exploded view of a corner anchor of the present invention.

With reference to FIGS. 4 and 5, each associated pair of linking bores of the first and second wall panels has an corner anchor 28 therein coupling the first wall panel to the second wall panel. Each corner anchor has a threaded bolt 29 and a threaded nut 30 threaded on to the threaded bolt of the respective corner anchor. The threaded nut of each corner anchor has a spaced apart pair of anchoring arms 31,32 outwardly extending into the associated linking bore of the first side of the first wall panel. Each of the anchoring arms has a side flange 33,34. The side flanges of the pair of anchoring arms outwardly extend away from one another and are inserted into the first wall panel to hold the threaded nut to the first wall panel. The threaded bolt of each corner anchor has a generally rectangular end plate 35 coupled to an end of the respective threaded bolt positioned adjacent the second face of the second wall panel. The end plate abuts the second face of the second wall panel to hold the second wall panel between the first wall panel and the end plate. The end plate has an width greater than a diameter of the associated linking bore of the second wall panel to prevent insertion of the end plate into the linking bore of the second wall panel.

Figure 2:
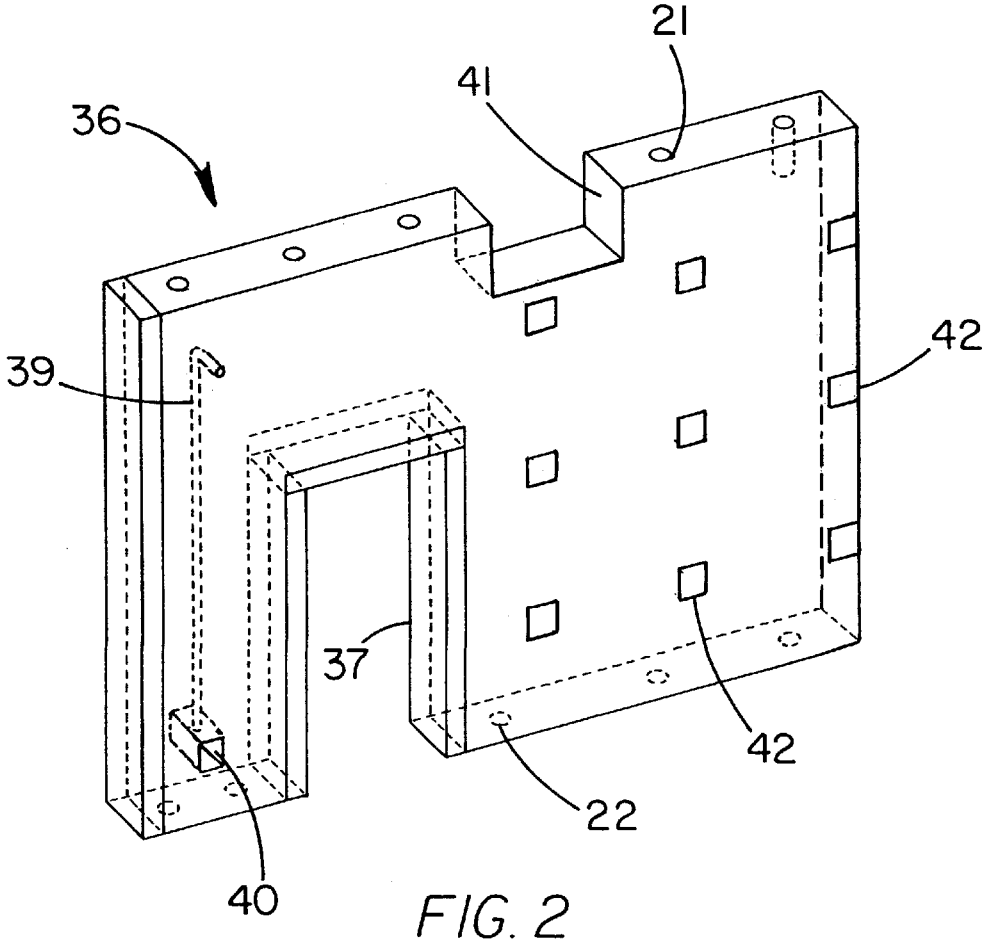
FIG. 2 is a schematic perspective view of a wall panel of the present invention.
Figure 3:
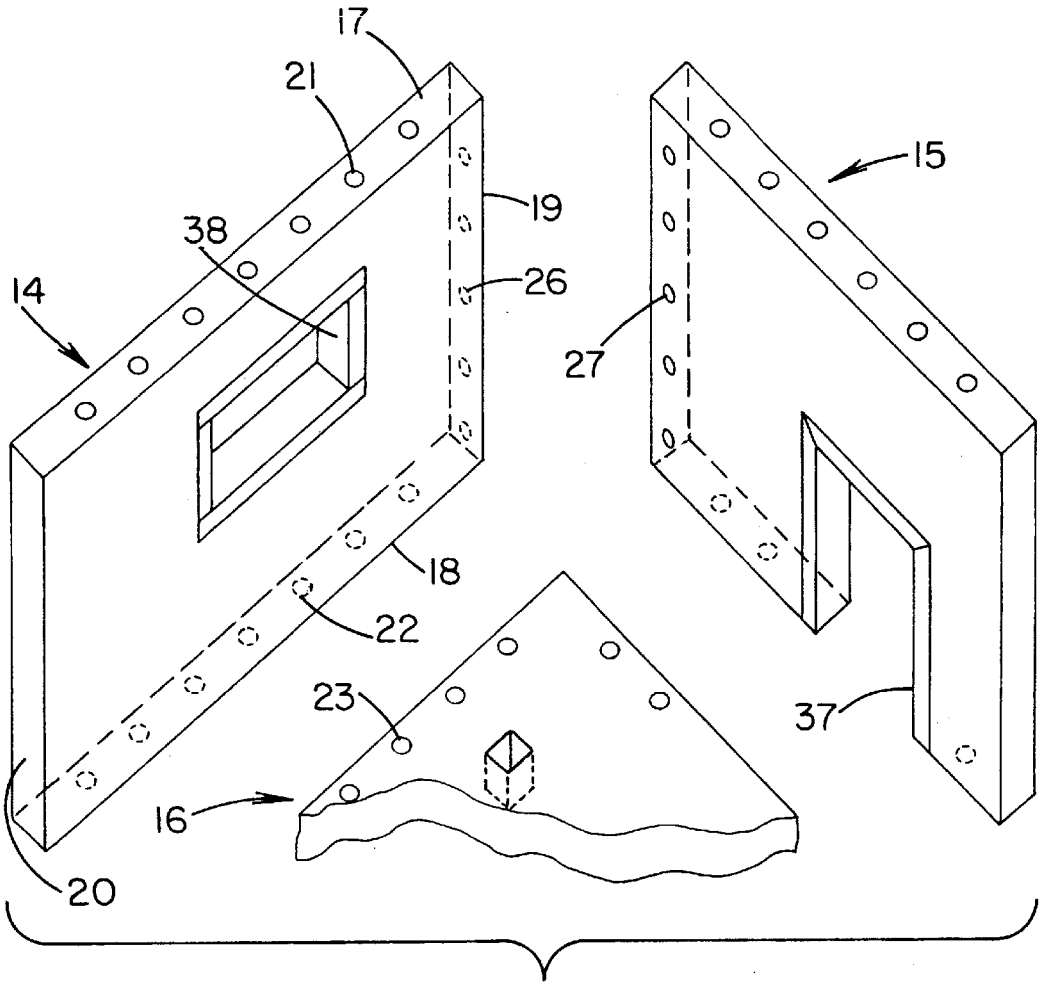
FIG. 3 is a schematic exploded view of a pair of wall panels and a floor panel of the present invention for forming a corner of a building structure.

As illustrated in FIGS. 2 and 3, at least one of the wall panels 15,36 has a door opening 37 therethrough between the first and second faces of the respective wall panel. The door opening positioned adjacent the bottom edge of respective wall panel and extends towards the top edge of the respective wall panel. As illustrated in FIG. 3, at least one of the wall panels has a window opening 38 therethrough between the first and second faces of the respective wall panel. The window opening is positioned between the top and bottom edges of the respective wall panel.

As illustrated in FIG. 2, preferably at least one of the wall panels has conduit passage 39 having at least two openings therein on one of the faces of the respective wall panel. In use, the conduit passage is designed for passing electrical conduit therethrough. The conduit passage may include a generally rectangular recess 40 at one of the openings of the conduit passage designed for installing an electrical box therein.

As also illustrated in FIG. 2, at least one of the wall panels may include a venting opening 41 therethrough between the first and second faces of the respective wall panel. The venting opening is preferably positioned adjacent the top edge of respective wall panel. In use, the venting opening is designed for permitting passing of ventilation conduits, plumbing conduits, and electrical conduits therethrough.

Preferably, the floor panel includes at least one hole therethrough between the first and second faces of the floor panel to permit passage of plumbing conduits therethrough.

As illustrated in FIG. 2, at least one face of at least one of the wall panels has a plurality of generally trapezoidal or rectangular mounting blocks 42 embedded therein. The rectangular mounting blocks are arranged in a rectangular grid like fashion on the associated face of the respective wall panel. Preferably, the rectangular mounting blocks are spaced apart at generally equal intervals along the grid. Ideally, the interval between rectangular mounting blocks is about 16 inches. Preferably, the mounting blocks on one face do not line up with the mounting blocks of the other face of the wall panel. In use, the mounting blocks are designed mounting items to the wall panels. For example, each of the blocks may have a dowel outwardly extending from the face of the wall panel designed for securing drywall, siding, stucco, to the wall panel With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A building system, comprising:

a plurality of panels each comprising an outer shell substantially surrounding an inner core;

said outer shell comprising a concrete material;

said inner core, comprising a mixture of a concrete material and particulate foamed polystyrene;

a pair of reinforcing meshes being embedded in said outer core such that said inner core is interposed between said reinforcing meshes, said reinforcing meshes each having a plurality of wires arranged in a grid-like fashion forming a plurality of generally square spaces therebetween;

a first and second wall panels of said plurality of panels having an associated pair of linking bores, said linking bores having a corner anchor therein coupling said first wall panel to said second wall panel; and each corner anchor having a threaded bolt and a threaded nut threadable on to said threaded bolt of the respective corner anchor for coupling together associated corners of said wall panels wherein said threaded nut of each corner anchor further comprises a spaced apart pair of anchoring arms outwardly extending into the associated linking bore of said first side of said first wall panel.

2. The building system of claim 1, wherein said outer shell defines a space therein, said inner core substantially occupying said space defined by said outer shell.

3. The building system of claim 1, wherein said concrete material of said outer shell comprises at least about 98 percent by volume of said outer shell.

4. The building system of claim 1, wherein said concrete material of said inner shell comprises about 94 percent by volume of said inner shell, wherein said particulate foamed polystyrene of said inner shell comprises about 6 percent by volume of said inner shell.

5. The building system of claim 1, wherein said outer shell and said inner core each have a thickness, wherein said thickness of said inner core is greater than said thickness of said outer shell.

6. The building system of claim 5, wherein said thickness of said outer shell is about 1 inch.

7. The building system of claim 1, wherein each of said spaces of said reinforcing meshes has a length and a width about equal to one another.

8. The building system of claim 7, wherein said length of each space of said reinforcing meshes is about 2 inches and said width of each space of said reinforcing meshes is about 2 inches.

9. The building system of claim 1, wherein each of said panels is generally rectangular and having a generally rectangular outer perimeter, and first and second faces, said plurality of panels including at least one wall panel, and at least one floor panel, said bottom edges of said wall panels being rested on said first face of said floor panel such that said wall panels are extended substantially perpendicular to said floor panel.

10. A building system, comprising:

a plurality of panels each comprising an outer shell substantially surrounding an inner core;

said outer shell defining a space therein, said inner core substantially occupying said space defined by said outer shell;

said outer shell comprising a concrete material, wherein said concrete material of said outer shell comprises at least about 98 percent by volume of said outer shell;

said inner core comprising a mixture of a concrete material and particulate foamed polystyrene;

wherein said concrete material of said inner shell comprises about 94 percent by volume of said inner shell, wherein said particulate foamed polystyrene of said inner shell comprises about 6 percent by volume of said inner shell;

said outer shell and said inner core each having a thickness, wherein said thickness of said inner core is greater than said thickness of said outer shell;

wherein said thickness of said outer shell is about 1 inch;

a pair of reinforcing meshes being embedded in said outer core such that said inner core is interposed between said reinforcing meshes, said reinforcing meshes each having a plurality of wires arranged in a grid-like fashion forming a plurality of generally square spaces therebetween;

each of said spaces of said reinforcing meshes having a length and a width about equal to one another, wherein said length of each space of each reinforcing mesh is about 2 inches and said width of each space of each reinforcing mesh is about 2 inches;

each of said panels being generally rectangular and having a generally rectangular outer perimeter, and first and second faces;

said plurality of panels including at least one wall panel, and at least one floor panel;

said outer perimeter of each wall panel having top and bottom edges and a pair of side edges extending between said top and bottom edges of the respective wall panel;

said top and bottom edge of each wall panel being extended substantially parallel to one another and substantially perpendicular to said side edges of the respective wall panel;

said top and bottom edges of each wall panel having a row of generally cylindrical bores therein extending between side edges of the respective wall panel, said bores of each edge being spaced apart in the respective row at generally equal intervals;

said bores of said top and bottom edges of said wall panels each having a diameter of about 1¼ inches;

said floor panel being adapted for positioning in a generally horizontal position such that said first and second faces of said floor panel lie in generally horizontal planes;

said floor panel having a plurality of spaced apart generally cylindrical bores therethrough between said first and second faces of said floor panel, said bores of said floor panel being arranged around said outer perimeter of said floor panel;

said bores of said floor panel being spaced apart at about equal intervals;

wherein said interval between bores of said floor panel is about equal to said interval between bores of said bottom edge of said wall panel said bottom edges of said wall panels being rested on said first face of said floor panel such that said wall panels are extended substantially perpendicular to said floor panel;

a first of said wall panels being positioned along a first side of said floor panel, a second of said walls panels being positioned along a second side of said floor panel adjacent said first side of said floor panel;

each of said bores of said bottom edge of said first wall panel being associated with a corresponding bore of said floor panel adjacent said first side of said floor panel;

each of said bores of said bottom edge of said second wall panel being associated with a corresponding bore of said floor panel adjacent said second side of said floor panel;

said bores of said bottom edges of said first and second wall panels being generally coaxially aligned with the associated corresponding bore of said floor panel;

a plurality of rebar;

a rebar of said plurality of rebar being upwardly extended through each bore of said floor panel into the associated bore of the bottom of the respective wall panel to hold the respective wall panel substantially perpendicular to said floor panel;

each rebar having a generally rectangular base coupled to an end of the respective rebar adjacent said second face of said floor panel, said bases of said rebar abutting said second face of said floor panel;

a first side edge of said first wall panel abutting said first face of said second wall panel adjacent a first side edge of said second wall panel;

said first side edge of said first wall panel having a row of linking bores therein extending between said top and bottom edges of said first wall panel, said linking bores of said first side edge of said first wall panel being spaced apart in said row at generally equal intervals;

said second wall panel having a row of linking bores extending therethrough between said first and second faces of said second wall panel adjacent said first of said side edges of said second wall panel;

each of said linking bores of said first side edge of said first wall panel being associated with a corresponding linking bore of said second wall panel;

said linking bores of said first side edge of said first wall panel being generally coaxially aligned with the associated corresponding linking bore of said second bore;

each associated pair of linking bores of said first and second wall panels having a corner anchor therein coupling said first wall panel to said second wall panel;

each corner anchor having a threaded bolt and a threaded nut threaded on to said threaded bolt of the respective corner anchor;

said threaded nut of each corner anchor having a spaced apart pair of anchoring arms outwardly extending into the associated linking bore of said first side of said first wall panel, each of said anchoring arms having a side flange, said side flanges of said pair of anchoring arms outwardly extending away from one another and being inserted into said first wall panel to hold said threaded nut to said first wall panel;

said threaded bolt of each corner anchor having a generally rectangular end plate coupled to an end of the respective threaded bolt positioned adjacent said second face of said second wall panel, said end plate abutting said second face of said second wall panel to hold said second wall panel between said first wall panel and said end plate;

at least one of said wall panels having a door opening therethrough between said first and second faces of the respective wall panel, said door opening positioned adjacent said bottom edge of respective wall panel and extending towards said top edge of the respective wall panel;

at least one of said wall panels having a window opening therethrough between said first and second faces of the respective wall panel, said door opening positioned between said top and bottom edges of the respective wall panel;

at least one of said wall panels having conduit passage having at least two openings therein on one of said faces of the respective wall panel;

said conduit passage being adapted for passing electrical conduit therethrough;

said conduit passage having a generally rectangular recess at one of said openings of said conduit passage, said recess being adapted for installing an electrical box therein;

at least one of said wall panels having a venting opening therethrough between said first and second faces of the respective wall panel, said venting opening positioned adjacent said top edge of respective wall panel;

said venting opening being adapted for permitting passing of ventilation conduits, plumbing conduits, and electrical conduits therethrough;

said floor panel having at least one hole therethrough between said first and second faces of said floor panel to permit passage of plumbing conduits therethrough; and at least one face of at least one of said wall panels having a plurality of generally rectangular mounting blocks therein, said rectangular mounting blocks being arranged in a rectangular grid like fashion on the associated face of the respective wall panel, said rectangular mounting blocks being spaced apart at generally equal intervals along said grid, wherein said interval between mounting blocks is about 16 inches.

11. The building system of claim 1, wherein each of said anchoring arms comprises a side flange, said side flanges of said pair of anchoring arms outwardly extending away from one another and being inserted into said first wall panel to hold said threaded nut to said first wall panel for preventing the threaded nut from moving inside the bore.

12. The building system of claim 1, wherein said threaded bolt of each corner anchor having a generally rectangular end plate coupled to an end of the respective threaded bolt positioned adjacent said second face of said second wall panel, said end plate abutting said second face of said second wall panel to hold said second wall panel between said first wall panel and said end plate.

13. A building system, comprising:

a plurality of panels each comprising an outer shell substantially surrounding an inner core;

said outer shell defining a space therein, said inner core substantially occupying said space defined by said outer shell;

said outer shell comprising a concrete material;

said inner core comprising a mixture of a concrete material and particulate foamed polystyrene;

said outer shell and said inner core each having a thickness, wherein said thickness of said inner core is greater than said thickness of said outer shell;

a pair of reinforcing meshes being embedded in said outer core such that said inner core is interposed between said reinforcing meshes;

each of said panels being generally rectangular and having an outer perimeter, and first and second faces;

said plurality of panels including at least one wall panel, and at least one floor panel;

said outer perimeter of each wall panel having top and bottom edges and a pair of side edges extending between said top and bottom edges of the respective wall panel;

said top and bottom edge of each wall panel being extended substantially parallel to one another and substantially perpendicular to said side edges of the respective wall panel;

said top and bottom edges of each wall panel having a row of bores therein extending between side edges of the respective wall panel, said bores of each edge being spaced apart in the respective row at generally equal intervals;

said floor panel being adapted for positioning in a generally horizontal position such that said first and second faces of said floor panel lie in generally horizontal planes;

said floor panel having a plurality of spaced apart generally cylindrical bores therethrough between said first and second faces of said floor panel, said bores of said floor panel being arranged around said outer perimeter of said floor panel;

said bores of said floor panel being spaced apart at about equal intervals;

wherein said interval between bores of said floor panel is about equal to said interval between bores of said bottom edge of said wall panel said bottom edges of said wall panels being rested on said first face of said floor panel such that said wall panels are extended substantially perpendicular to said floor panel;

a first of said wall panels being positioned along a first side of said floor panel, a second of said walls panels being positioned along a second side of said floor panel adjacent said first side of said floor panel;

each of said bores of said bottom edge of said first wall panel being associated with a corresponding bore of said floor panel adjacent said first side of said floor panel;

each of said bores of said bottom edge of said second wall panel being associated with a corresponding bore of said floor panel adjacent said second side of said floor panel;

said bores of said bottom edges of said first and second wall panels being generally coaxially aligned with the associated corresponding bore of said floor panel;

a plurality of rebar;

a rebar of said plurality of rebar being upwardly extended through each bore of said floor panel into the associated bore of the bottom of the respective wall panel to hold the respective wall panel substantially perpendicular to said floor panel;

each rebar having a base coupled to an end of the respective rebar adjacent said second face of said floor panel, said bases of said rebar abutting said second face of said floor panel;

a first side edge of said first wall panel abutting said first face of said second wall panel adjacent a first side edge of said second wall panel;

said first side edge of said first wall panel having a row of linking bores therein extending between said top and bottom edges of said first wall panel, said linking bores of said first side edge of said first wall panel being spaced apart in said row at generally equal intervals;

said second wall panel having a row of linking bores extending therethrough between said first and second faces of said second wall panel adjacent said first of said side edges of said second wall panel;

each of said linking bores of said first side edge of said first wall panel being associated with a corresponding linking bore of said second wall panel;

said linking bores of said first side edge of said first wall panel being generally coaxially aligned with the associated corresponding linking bore of said second bore;

each associated pair of linking bores of said first and second wall panels having a corner anchor therein coupling said first wall panel to said second wall panel;

each corner anchor having a threaded bolt and a threaded nut threaded on to said threaded bolt of the respective corner anchor;

said threaded nut of each corner anchor having a spaced apart pair of anchoring arms outwardly extending into the associated linking bore of said first side of said first wall panel, each of said anchoring arms having a side flange, said side flanges of said pair of anchoring arms outwardly extending away from one another and being inserted into said first wall panel to hold said threaded nut to said first wall panel;

said threaded bolt of each corner anchor having an end plate coupled to an end of the respective threaded bolt positioned adjacent said second face of said second wall panel, said end plate abutting said second face of said second wall panel to hold said second wall panel between said first wall panel and said end plate;

at least one of said wall panels having a door opening therethrough between said first and second faces of the respective wall panel, said door opening positioned adjacent said bottom edge of respective wall panel and extending towards said top edge of the respective wall panel;

at least one of said wall panels having a window opening therethrough between said first and second faces of the respective wall panel, said door opening positioned between said top and bottom edges of the respective wall panel;

at least one of said wall panels having conduit passage having at least two openings therein on one of said faces of the respective wall panel;

said conduit passage being adapted for passing electrical conduit therethrough;

said conduit passage having a recess at one of said openings of said conduit passage, said recess being adapted for installing an electrical box therein;

at least one of said wall panels having a venting opening therethrough between said first and second faces of the respective wall panel, said venting opening positioned adjacent said top edge of respective wall panel;

said venting opening being adapted for permitting passing of ventilation conduits, plumbing conduits, and electrical conduits therethrough;

said floor panel having at least one hole therethrough between said first and second faces of said floor panel to permit passage of plumbing conduits therethrough; and at least one face of at least one of said wall panels having a plurality of mounting blocks therein, said mounting blocks being arranged in a rectangular grid like fashion on the associated face of the respective wall panel, said mounting blocks being spaced apart at generally equal intervals along said grid.

14. The building system of claim 10, wherein said concrete material of said outer shell further comprises at least about 98 percent by volume of said outer shell and about 94 percent by volume of said inner shell, wherein said particulate foamed polystyrene of said inner shell comprises about 6 percent by volume of said inner shell.

* * * * *